US008695209B2

(12) United States Patent
Saito et al.

(10) Patent No.: US 8,695,209 B2
(45) Date of Patent: Apr. 15, 2014

(54) METHOD OF PRODUCING A SURFACE-MOUNT INDUCTOR

(75) Inventors: Koichi Saito, Tsurugashima (JP); Chitoshi Sakai, Tsurugashima (JP)

(73) Assignee: TOKO, Inc., Saitama (JP)

( * ) Notice: Subject to any disclaimer, the term of this patent is extended or adjusted under 35 U.S.C. 154(b) by 542 days.

(21) Appl. No.: 12/757,644

(22) Filed: Apr. 9, 2010

(65) Prior Publication Data

US 2010/0259353 A1 Oct. 14, 2010

(30) Foreign Application Priority Data

Apr. 10, 2009 (JP) ..... 2009-095582

(51) Int. Cl.
*H01F 7/06* (2006.01)

(52) U.S. Cl.
USPC ..... 29/602.1; 29/604; 29/832; 29/841; 439/620.09; 336/83; 336/200; 336/208

(58) Field of Classification Search
USPC ..... 29/602.1, 604, 607–609, 832, 841, 825, 29/829, 846; 336/83, 96, 197, 199, 200, 336/205, 208; 439/620.09, 620.13, 55; 257/787; 438/478, 481, 41, 341, 388, 438/328, 25, 26, 105, 125–127
See application file for complete search history.

(56) References Cited

U.S. PATENT DOCUMENTS

| | | | | |
|---|---|---|---|---|
| 6,275,132 | B1 | 8/2001 | Shikama et al. | |
| 6,759,935 | B2 | 7/2004 | Moro et al. | |
| 6,914,506 | B2 * | 7/2005 | Gallup et al. | 336/83 |
| 8,156,634 | B2 * | 4/2012 | Gallup et al. | 29/605 |
| 2005/0030143 | A9 | 2/2005 | Satoh et al. | |
| 2006/0001517 | A1 * | 1/2006 | Cheng | 336/83 |

FOREIGN PATENT DOCUMENTS

| | | |
|---|---|---|
| CN | 1215900 | 5/1999 |
| CN | 1464516 | 12/2003 |
| JP | 4-284609 | 10/1992 |
| JP | 7-320938 | 12/1995 |

(Continued)

OTHER PUBLICATIONS

Search Report issued on Jul. 18, 2012 in related Chinese Patent Application No. 201010145551.9.

*Primary Examiner* — Peter DungBa Vo
*Assistant Examiner* — Jeffrey T Carley
(74) *Attorney, Agent, or Firm* — Cozen O'Connor

(57) ABSTRACT

A method of producing a surface-mount inductor by encapsulating a coil with an encapsulation material containing a resin and a filler using a mold die assembly is provided. In the method, a tablet and a coil are used. The tablet is prepared by preforming the encapsulation material into a shape having a flat plate-shaped portion and a pillar-shaped convex portion on a peripheral thereof. The coil is a wound conductive wire having a cross-section of rectangular-shape. The coil is placed on the tablet to allow both ends of the coil to extend along an outer side surface of the pillar-shaped convex portion of the tablet. The coil and the encapsulation material are integrated together while clamping the both ends of the coil between an inner wall surface of the mold die assembly and the outer side surface of the pillar-shaped convex portion of the tablet, to form a molded body. External electrodes are formed on a surface of or around an outer periphery of the molded body in such a manner that the external electrodes are electrically connected to the both ends of the coil at least a portion of which is exposed to the surface of the molded body.

4 Claims, 8 Drawing Sheets

(56) References Cited

FOREIGN PATENT DOCUMENTS

| | | | | |
|---|---|---|---|---|
| JP | 2001-267160 | * 12/2000 | ..... | H01F 41/02 |
| JP | 2001-267160 | 9/2001 | | |
| JP | 2003-217958 | 7/2003 | | |
| JP | 2003-282346 | 10/2003 | | |
| JP | 2003-290992 | 10/2003 | | |
| JP | 2005-294461 | 10/2005 | | |
| JP | 2007-123306 | 5/2007 | | |
| JP | 2008-041924 | 2/2008 | | |
| TW | 2006 03184 | 1/2006 | | |

* cited by examiner

METHOD OF PRODUCING A SURFACE-MOUNT INDUCTOR

BACKGROUND OF THE INVENTION

1. Field of the Invention

The present invention relates to a method of producing a surface-mount inductor, and a surface-mount inductor produced by the method.

2. Description of the Background Art

Currently, a surface-mount inductor is widely used which has a structure where a coil is encapsulated by an encapsulation material containing a magnetic powder and a resin. As a conventional technique of producing a surface-mount inductor, there has been known a surface-mount inductor production method using a lead frame, as disclosed, for example, in JP 2003-290992A. In this method, opposite ends of a coil are joined to a lead frame by resistance welding or the like. Then, the entire coil is encapsulated by an encapsulation material to obtain a molded body. A portion of the lead frame exposed from the molded body is subjected to shaping, such as bending, to form an external electrode.

Recent technical innovation in downsizing and functional upgrading of electronic devices is remarkable. In connection therewith, electronic components, such as a surface-mount inductor, are required to achieve higher performance, smaller size and lower cost. However, the conventional method using a lead frame involves a problem of a large material loss in the lead frame, which becomes a factor causing an increase in cost. Moreover, even if the ends of the coil are joined to the lead frame by means of resistance welding or the like, the joined portion between the lead frame and each of the ends of the coil is likely to be separated from each other due to a springback phenomenon in the coil.

Therefore, there has been proposed a method intended to subject opposite ends of a coil to shaping to form an external electrode, as disclosed, for example, in JP 2003-282346A and JP 2005-294461A. In a method disclosed in the JP 2003-282346A, a pair of upper and lower mold dies are used. A coil is fixed by clamping opposite ends (lead-out terminals) of the coil between terminal clamping portions of the pair of upper and lower mold dies. However, in a process of producing a small-sized surface-mount inductor, a diameter of a wire for use as the coil has to be set to a relatively small value in order to obtain a required number of turns. In this case, if the wire diameter is excessively small, it is difficult to fix the coil only through the ends thereof. Thus, this method is hardly used to produce a small-sized surface-mount inductor. Moreover, in this method, it is necessary to change dimensions of the terminal clamping portion of each of the mold dies depending on a diameter of a wire for use as the coil in each case.

In a method disclosed in the JP 2005-294461A, opposite ends of a coil are bent downwardly. The coil is placed within a mold die assembly in such a manner that an outer surface of each of the ends is brought into contact with an inner surface of the mold die assembly. An encapsulation material is charged into the mold die assembly to allow the coil to be buried in the encapsulation material. However, in this method, the ends have to be formed to support a wound portion of the coil while keeping a hollow space therebetween. Therefore, the ends of the coil are required to have a certain level of strength. If the coil is formed of a relatively thin wire, the strength of the ends of the wire becomes insufficient to cause difficulty in supporting the wound portion while keeping a hollow space therebetween. Moreover, displacement or deformation of the coil is likely to occur during the operation of charging the encapsulation material. Thus, this method is hardly used to produce a small-sized surface-mount inductor.

SUMMARY OF THE INVENTION

It is an object of the present invention to provide a method capable of producing a small-sized surface-mount inductor at a low cost, while achieving an adequate contact between an external electrode and each of opposite ends of the coil.

In order to achieve this object, the present invention provides a method of producing, using a mold die assembly, a surface-mount inductor having a structure where a coil is encapsulated by an encapsulation material containing a resin and a filler. The method comprises the steps of: preforming a tablet into a shape having a flat plate-shaped portion and a pillar-shaped convex portion on a peripheral edge of the flat plate-shaped portion, to serve as a part of the encapsulation material; winding a cross-sectionally rectangular-shaped conductive wire to form the coil; placing the coil on the tablet to allow opposite ends of the coil to extend along an outer surface of the pillar-shaped convex portion of the tablet; integrating the coil and the encapsulation material together while clamping the ends of the coil between an inner wall surface of the mold die assembly and the outer surface of the pillar-shaped convex portion of the tablet, to form a molded body; and forming an external electrode on a surface of the molded body or around an outer periphery of the molded body in such a manner that the external electrode is electrically connected to at least portions of the ends of the coil exposed to the surface of the molded body.

As above, in the surface-mount inductor production method of the present invention, a small-sized surface-mount inductor can be obtained in a simple manner. In addition, the coil can be embedded in the molded body while allowing at least portions of the opposite ends of the coil to be fixed at given positions of the molded body. Further, flat surfaces of the ends can be exposed to the surface of the molded body to obtain an adequate contact area with an external electrode. Furthermore, there is no need for clamping the ends of the coil between a pair of mold dies, which makes it possible to form the mold die assembly in a simple structure and at a low cost.

DESCRIPTION OF THE PREFERRED EMBODIMENTS

The present invention will now be described based on an embodiment thereof.

First Embodiment

Figure 1:
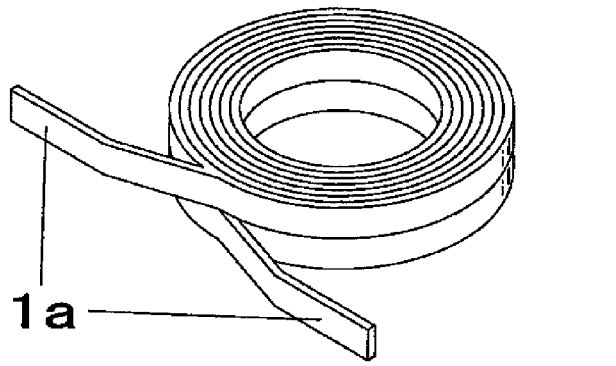
FIG. 1 is a perspective view showing an air-core coil for use in a surface-mount inductor production method according to a first embodiment of the present invention.

With reference to FIGS. 1 to 7, a surface-mount inductor production method according to a first embodiment of the present invention will be described. Firstly, an air-core coil for use in the first embodiment will be described. FIG. 1 is a perspective view of the air-core coil for use in the first embodiment. As shown in FIG. 1, the air-core coil 1 for use in the first embodiment is obtained by winding a rectangular (cross-sectionally rectangular-shaped) wire in a two-tiered spiral pattern. The air-core coil 1 is formed to allow each of opposite ends 1*a* thereof to be located at an outermost position. Further, the air-core coil 1 is formed to allow each of opposite ends 1*a* to be led out toward the same lateral side.

Figure 2:
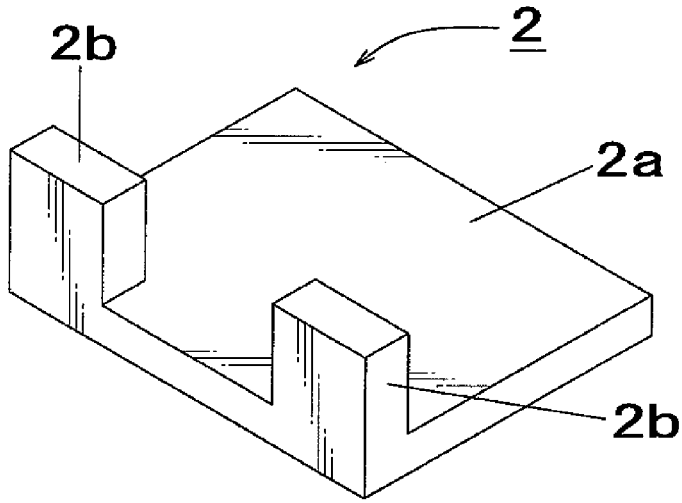
FIG. 2 is a perspective view showing a base tablet for use in the production method according to the first embodiment.

Secondly, an encapsulation material for use in the first embodiment will be described. The encapsulation material for use in the first embodiment is a mixture of an iron-based metal magnetic powder and an epoxy resin. A base tablet is formed using this encapsulation material. FIG. 2 is a perspective view showing a base tablet for use in the first embodiment. As shown in FIG. 2, the base tablet 2 has a flat plate-shaped portion 2*a* and two pillar-shaped convex portions 2*b*. The two pillar-shaped convex portions 2*b* are provided on one edge of the flat plate-shaped portion 2*a*. The base tablet 2 is subjected to a pressure forming process, and then subjected to a heat treatment to allow the encapsulating material to be placed in a half-set state.

Figure 3:
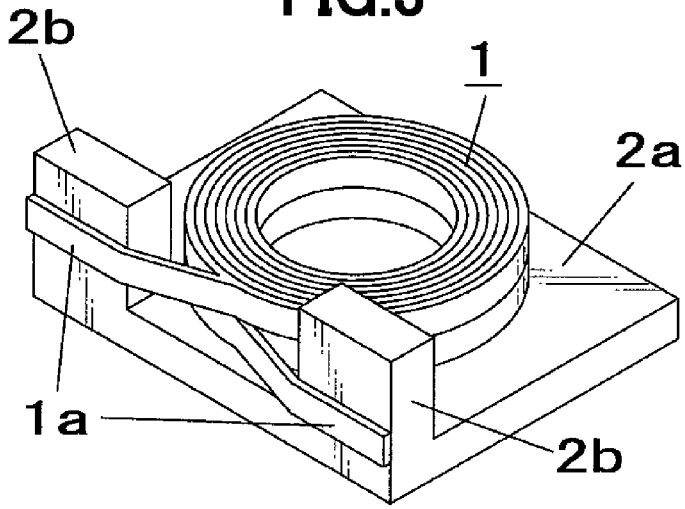
FIG. 3 is a perspective view for explaining a positional relationship between the air-core coil and the base tablet in the production method according to the first embodiment.
Figure 4A:
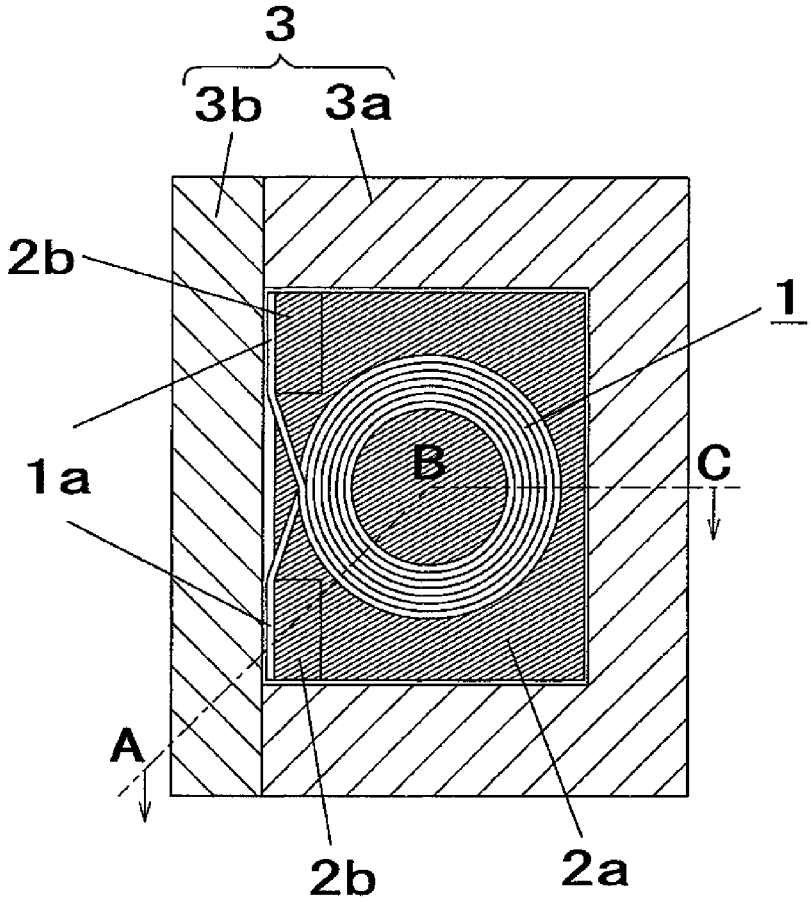
FIG. 4A is a top view showing an arrangement of the air-core coil and the base tablet within a mold die assembly, in the production method according to the first embodiment.
Figure 4B:
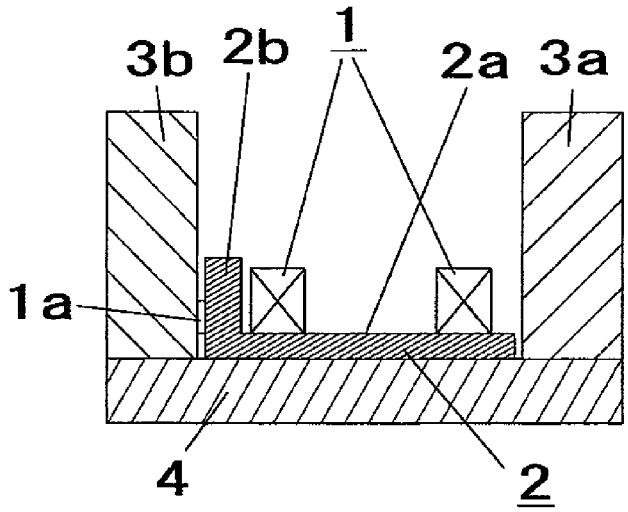
FIG. 4B is a combinational sectional view taken along the lines A-B and B-C in FIG. 4A.

The surface-mount inductor production method according to the first embodiment will be described below. Firstly, a positional relationship between the air-core coil 1 and the base tablet 2 will be described. FIG. 3 is an explanatory perspective view of the positional relationship between the air-core coil and the base tablet in the first embodiment. FIGS. 4A and 4B show an arrangement of the air-core coil and the base tablet within a mold die assembly, in the first embodiment, wherein FIG. 4A is a top view, and FIG. 4B is a combinational sectional view taken along the lines A-B and B-C in FIG. 4A. As shown in FIG. 3, the air-core coil 1 is placed on the flat plate-shaped portion 2*a* of the base tablet 2. Then, the ends 1*a* of the air-core coil 1 are arranged to extend along outer lateral surfaces of the pillar-shaped convex portions 2*b*, respectively.

As shown in FIGS. 4A and 4B, in the first embodiment, a mold die assembly comprising an upper die 3 and a lower die 4 is used. The upper die 3 includes a first upper die 3*a* and a second upper die 3*b*. The lower die 4 is combined with the upper die 3 to form a bottom portion of the mold die assembly. The base tablet 2 having the air-core coil 1 placed thereon is set up within the mold die assembly. In a state after the base tablet 2 is set up as shown in FIGS. 4A and 4B, the air-core coil 1 is located at an adequate height position within the mold die assembly according to a thickness of the flat plate-shaped portion 2*a* of the base tablet 2. Further, each of the ends 1*a* of the air-core coil 1 is clamped between an inner wall surface of the second upper die 3*b* and a corresponding one of the outer lateral surfaces of the pillar-shaped convex portions 2*b*, so that the ends 1*a* of the air-core coil 1 are fixed at adequate positions.

Figure 5:
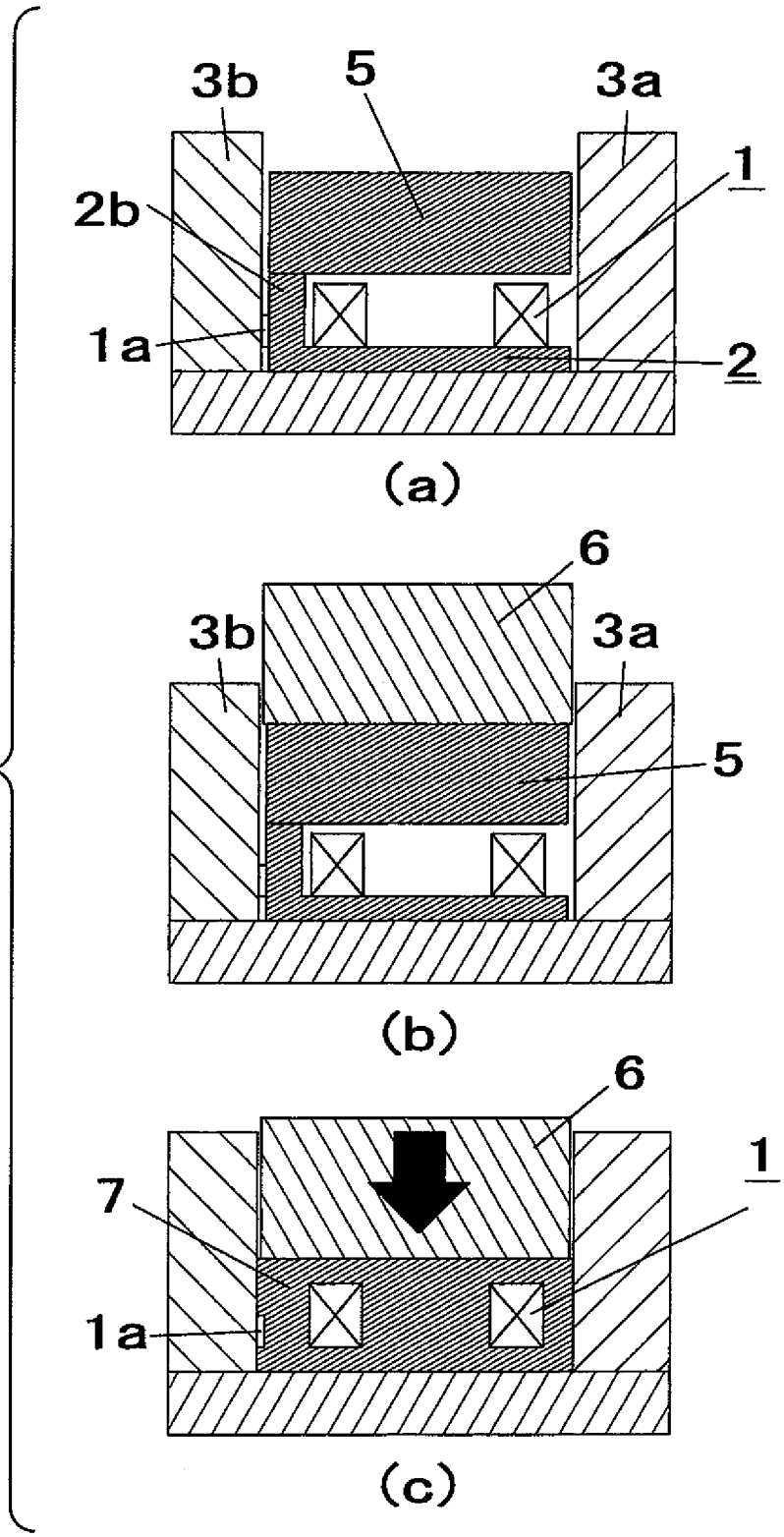
FIGS. 5(*a*) to 5(*c*) are sectional views showing a part of steps of the production method according to the first embodiment.
Figure 6:
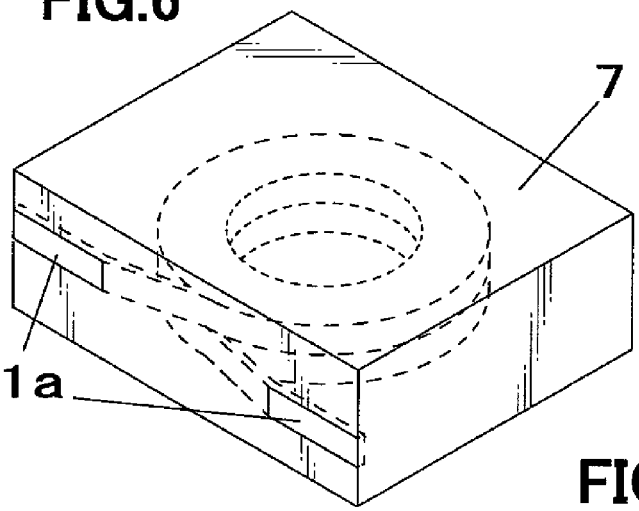
FIG. 6 is a perspective view showing a molded body in the production method according to the first embodiment.
Figure 7:
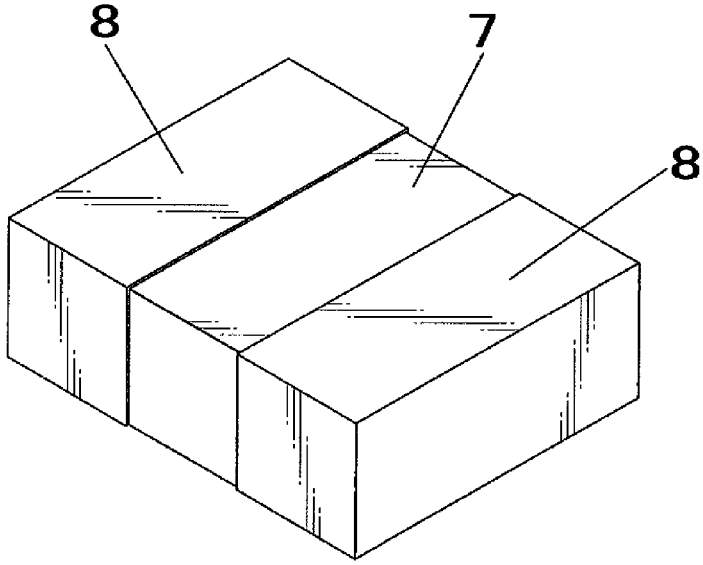
FIG. 7 is a perspective view showing a surface-mount inductor in the production method according to the first embodiment.

FIGS. 5(*a*) to 5(*c*) are sectional views showing a part of steps of the surface-mount inductor production method according to the first embodiment, wherein each of the sectional views corresponds the sectional view taken along the lines A-B and B-C in FIG. 4A. FIG. 6 is a perspective view showing a molded body in the first embodiment, and FIG. 7 is a perspective view showing a surface-mount inductor in the first embodiment.

As shown in FIG. 5(*a*), a preformed unset platy tablet 5 is charged from an opening (of the upper die 3) of the mold die assembly to cover the air-core coil 1, and then the mold die assembly is preheated. In the first embodiment, the platy tablet 5 used as a preformed material is prepared by preforming the same encapsulation material as that of the base tablet 2, into a plate shape. In the first embodiment, the mold die assembly is preheated up to a temperature equal to or greater that a softening temperature of the encapsulation material, so that each of the base tablet 2 and the platy tablet 5 is placed in a softened state.

Subsequently, as shown in FIG. 5(*b*), a punch 6 is inserted from the opening of the mold die assembly. Then, as shown in FIG. 5(*c*), the base tablet 2 and the platy tablet 5 are integrated together by a press action of the punch 6, and then the integrated encapsulation material 7 is hardened. During the integration, each of the base tablet 2 and the platy tablet 5 is kept in the softened state, so that the air-core coil 1 is readily encapsulated therewith. Further, the air-core coil 1 is encapsulated in such a manner that at least a part of the ends 1*a* of the air-core coil 1 is buried in the encapsulation material 7 without being displaced.

Subsequently, a molded body obtained by hardening the encapsulation material 7 is taken out of the mold die assembly. In this state, a flat surface of each of the ends 1*a* of the air-core coil 1 is exposed to a surface of the molded body, as shown in FIG. 6. Then, an electrically conductive resin is applied onto the surface of the molded body in such a manner that it is electrically connected to the ends 1*a*. Then, the molded body is subjected to plating to form an external electrode 8 thereon. In this manner, a surface-mount inductor as shown in FIG. 7 is obtained. The external electrode 8 may be formed by plating using one or more plating metals appropriately selected from the group consisting of Ni, Sn, Cu, Au and Pd.

Second Embodiment

With reference to FIGS. 8 to 12, a surface-mount inductor production method according to a second embodiment of the present invention will be described. In the second embodiment, the same rectangular wire as that in the first embodiment, and an encapsulation material having the same composition as that of the encapsulation material in the first embodiment are used. Descriptions about a common structure and process to those in the first embodiment will be omitted on a case-by-case basis.

Figure 8:
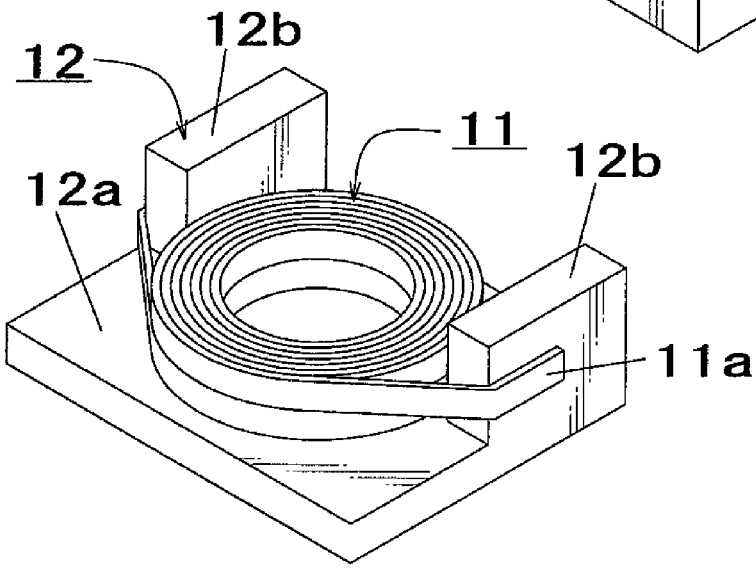
FIG. 8 is a perspective view for explaining a positional relationship between an air-core coil and a base tablet in a surface-mount inductor production method according to a second embodiment of the present invention.

FIG. 8 is a perspective view for explaining a positional relationship between an air-core coil and a base tablet in the second embodiment. The air-core coil 11 for use in the second embodiment is obtained by winding a rectangular wire in a two-tiered spiral pattern, in the same manner as that in the first embodiment. The air-core coil 11 is formed to allow each of opposite ends 11*a* thereof to be located at an outermost position. The base tablet 12 for use in the second embodiment is preformed into a shape having a flat plate-shaped portion 12*a*, and two pillar-shaped convex portions 12*b* on respective ones of opposed edges of the flat plate-shaped portion 12*a*. As shown in FIG. 8, the air-core coil 11 is placed on the flat plate-shaped portion 12*a* in such a manner that opposite ends 11*a* of the air-core coil 11 are arranged to extend along outer lateral surfaces of the pillar-shaped convex portions 12*b*, respectively.

Figure 9A:
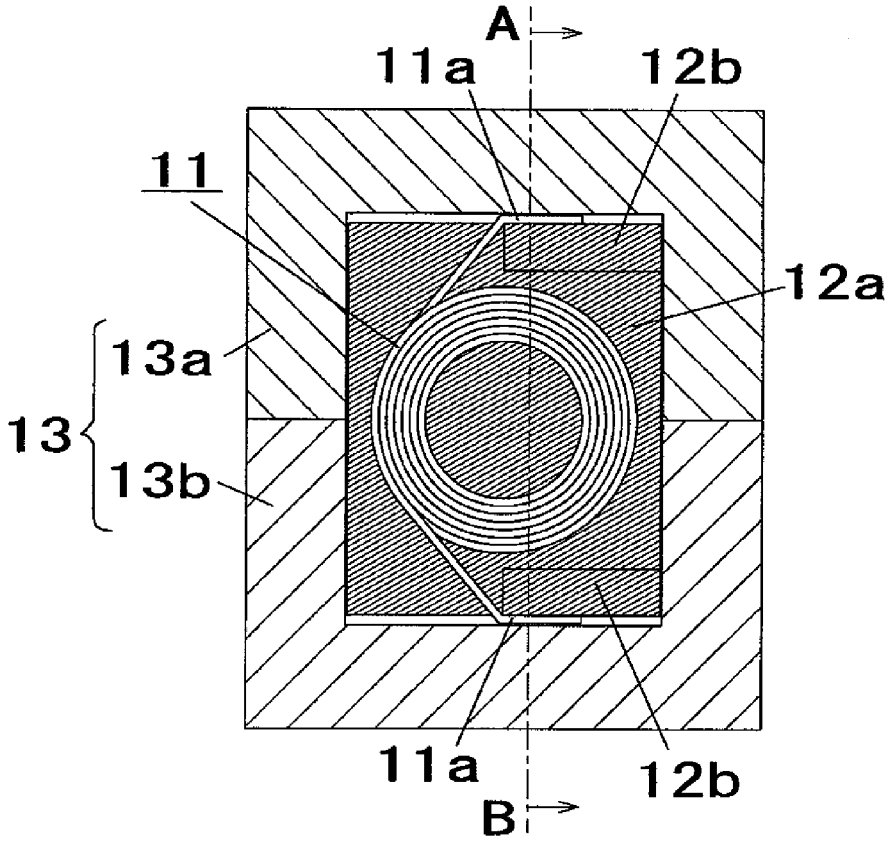
FIG. 9A is a top view showing an arrangement of the air-core coil and the base tablet within a mold die assembly, in the production method according to the second embodiment.
Figure 9B:
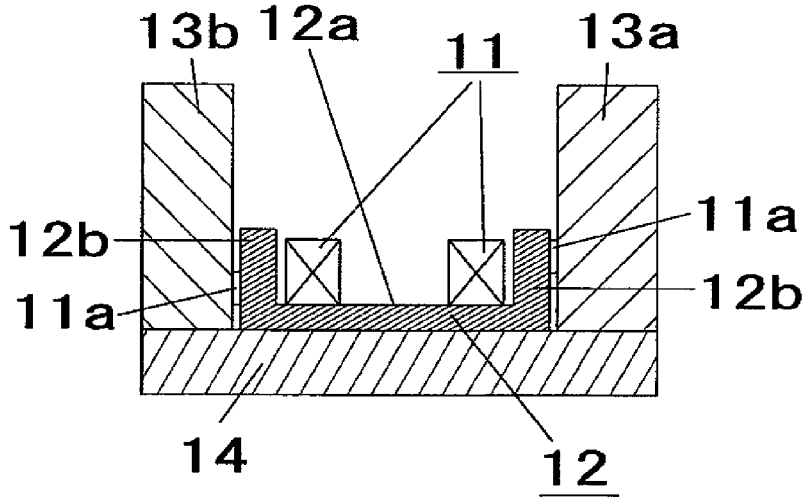
FIG. 9B is a sectional view taken along the line A-B in FIG. 9A.

FIGS. 9A and 9B show an arrangement of the air-core coil and the base tablet within a mold die assembly, in the second embodiment, wherein FIG. 9A is a top view, and FIG. 9B is a combinational sectional view taken along the line A-B in FIG. 9A. As shown in FIGS. 9A and 9B, in the second embodiment, a mold die assembly comprising an upper die 13 and a lower die 14 is used. The upper die 13 includes a first upper die 13*a* and a second upper die 13*b*. The lower die 14 is combined with the upper die 13 to form a bottom portion of the mold die assembly. The base tablet 12 having the air-core coil 11 placed thereon is set up within the mold die assembly. In a state after the base tablet 12 is set up as shown in FIGS. 9A and 9B, one of the ends 11*a* is clamped between an inner wall surface of the first upper die 13*a* and the outer lateral surface of one of the pillar-shaped convex portions 12*b*, and the other end 11*a* is clamped between an inner wall surface of the second upper die 13*b* and the outer lateral surfaces of the other pillar-shaped convex portion 12*b*. Thus, the air-core coil 11 is located at an adequate height position within the mold die assembly, and the ends 11*a* are fixed at adequate positions.

Figure 10:
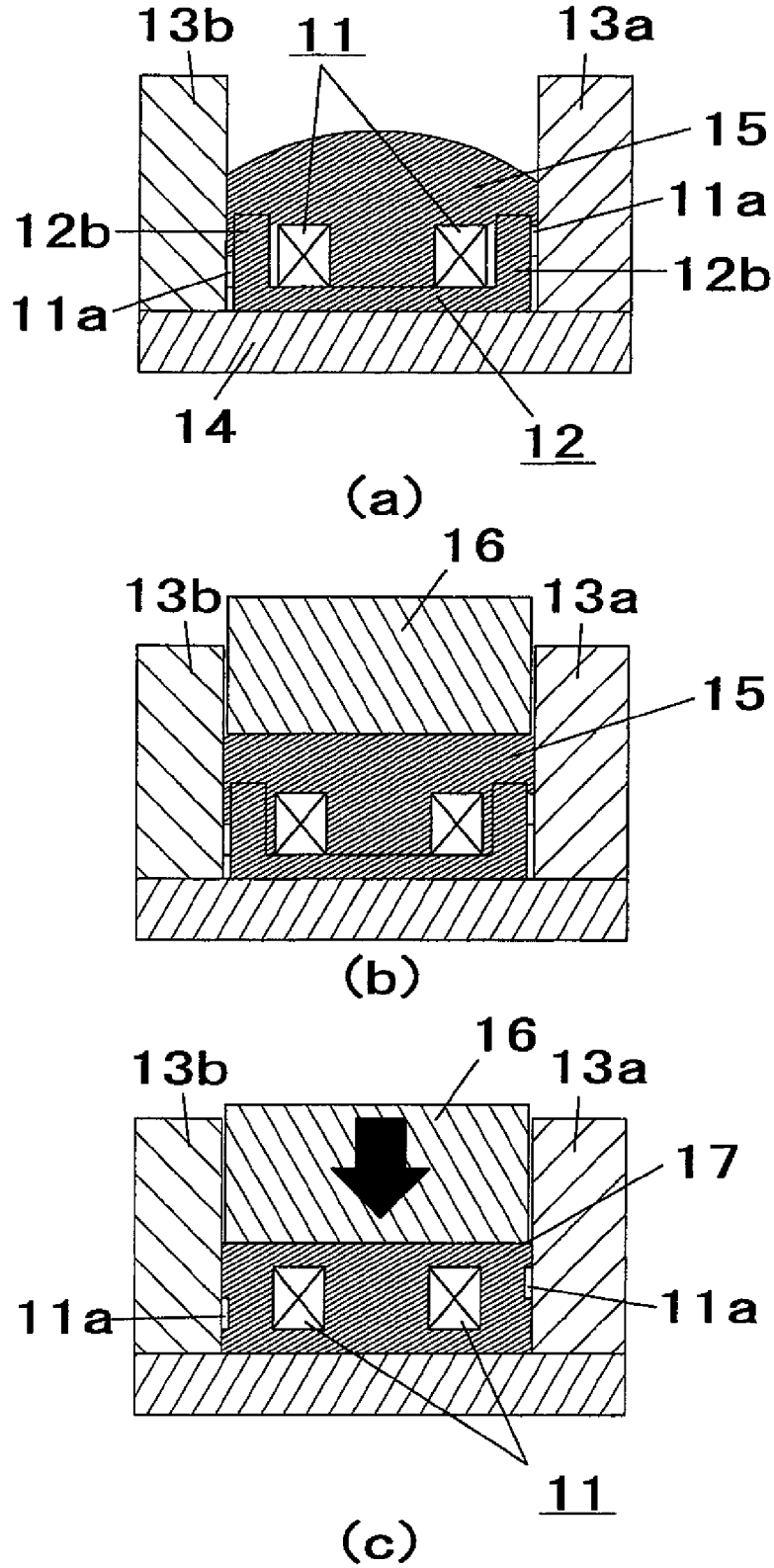
FIGS. 10(*a*) to 10(*c*) are sectional views showing a part of steps of the production method according to the second embodiment.
Figure 11:
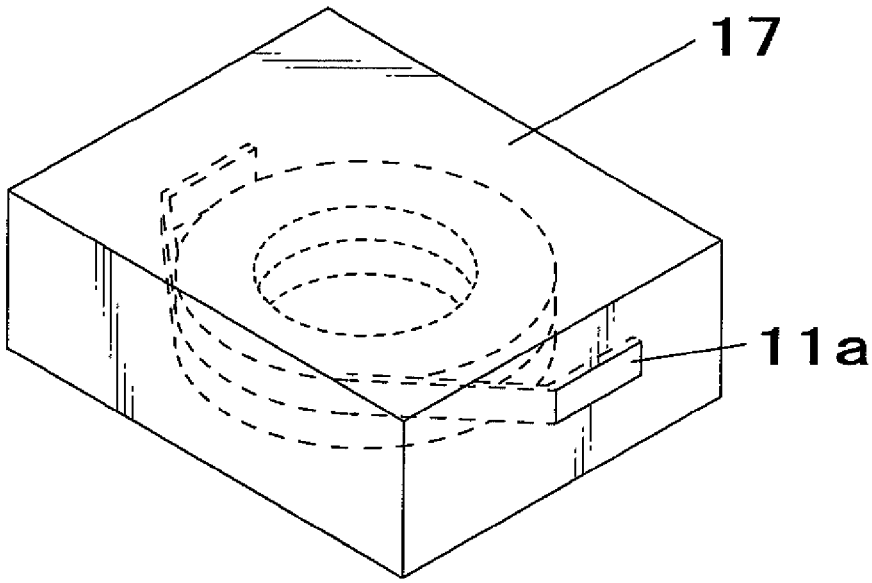
FIG. 11 is a perspective view showing a molded body in the production method according to the second embodiment.
Figure 12:
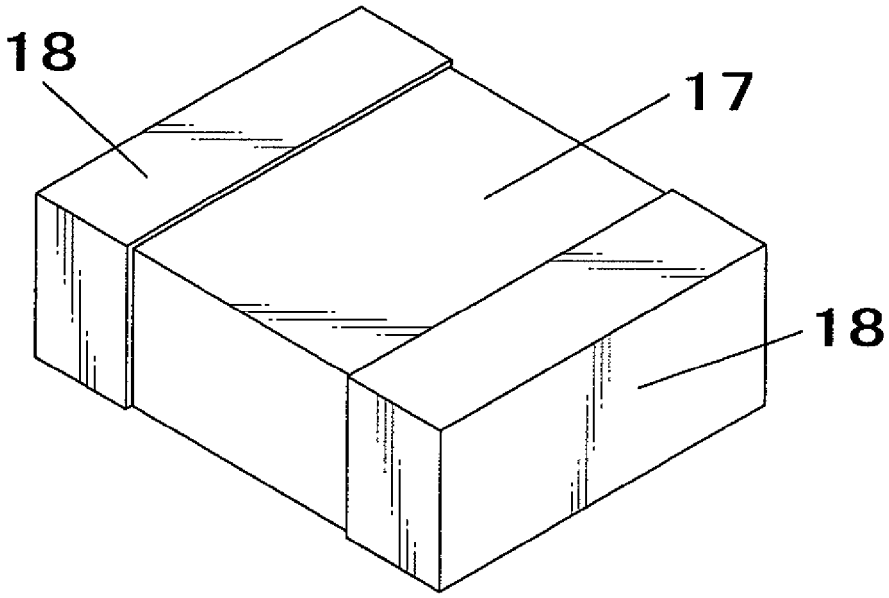
FIG. 12 is a perspective view showing a surface-mount inductor in the production method according to the second embodiment.

FIGS. 10(*a*) to 10(*c*) are sectional views showing a part of steps of the surface-mount inductor production method according to the second embodiment, wherein each of the sectional views corresponds the sectional view taken along the line A-B in FIG. 9A. FIG. 11 is a perspective view showing a molded body in the second embodiment, and FIG. 12 is a perspective view showing a surface-mount inductor in the second embodiment.

As shown in FIG. 10(*a*), a powdery material 15 weighted in a given amount is supplied from an opening (of the upper die 13) of the mold die assembly onto the air-core coil 11. In the second embodiment, the powdery material 15 is prepared by forming an encapsulation material having the same composition as that of the base tablet 12, in a powder form. Each of the base tablet 12 and the powdery material 15 is placed in an unset or half-set state.

Subsequently, as shown in FIG. 10(*b*), a punch 16 is inserted from the opening of the mold die assembly. Then, as shown in FIG. 10(*c*), the base tablet 12 and powdery material 15 are integrated together by a powder molding process (powder compacting process) using the punch 16, and then the integrated encapsulation material 17 is hardened. During the integration, the base tablet 12 is re-formed to encapsulate the air-core coil 11 therein in cooperation with powdery material 15. Further, the air-core coil 11 is encapsulated in such a manner that at least a part of the ends 11*a* of the air-core coil 11 is buried in the encapsulation material 17 without being displaced.

Subsequently, a molded body obtained by hardening the encapsulation material 17 is taken out of the mold die assembly, as shown in FIG. 11. In this state, a flat surface of each of the ends 11*a* of the air-core coil 11 is exposed to a corresponding one of opposed lateral surfaces of the molded body, as shown in FIG. 11. Then, an external electrode 18, such as a metal terminal, is attached to the molded body by soldering or the like, in such a manner that it is electrically connected to the ends 11*a*. In this manner, a surface-mount inductor as shown in FIG. 12 is obtained. The metal terminal may be formed of a phosphor-bronze plate, a copper plate or the like, and the molded body may be subjected to tin plating or the like according to need.

[Modifications]

Figure 13:
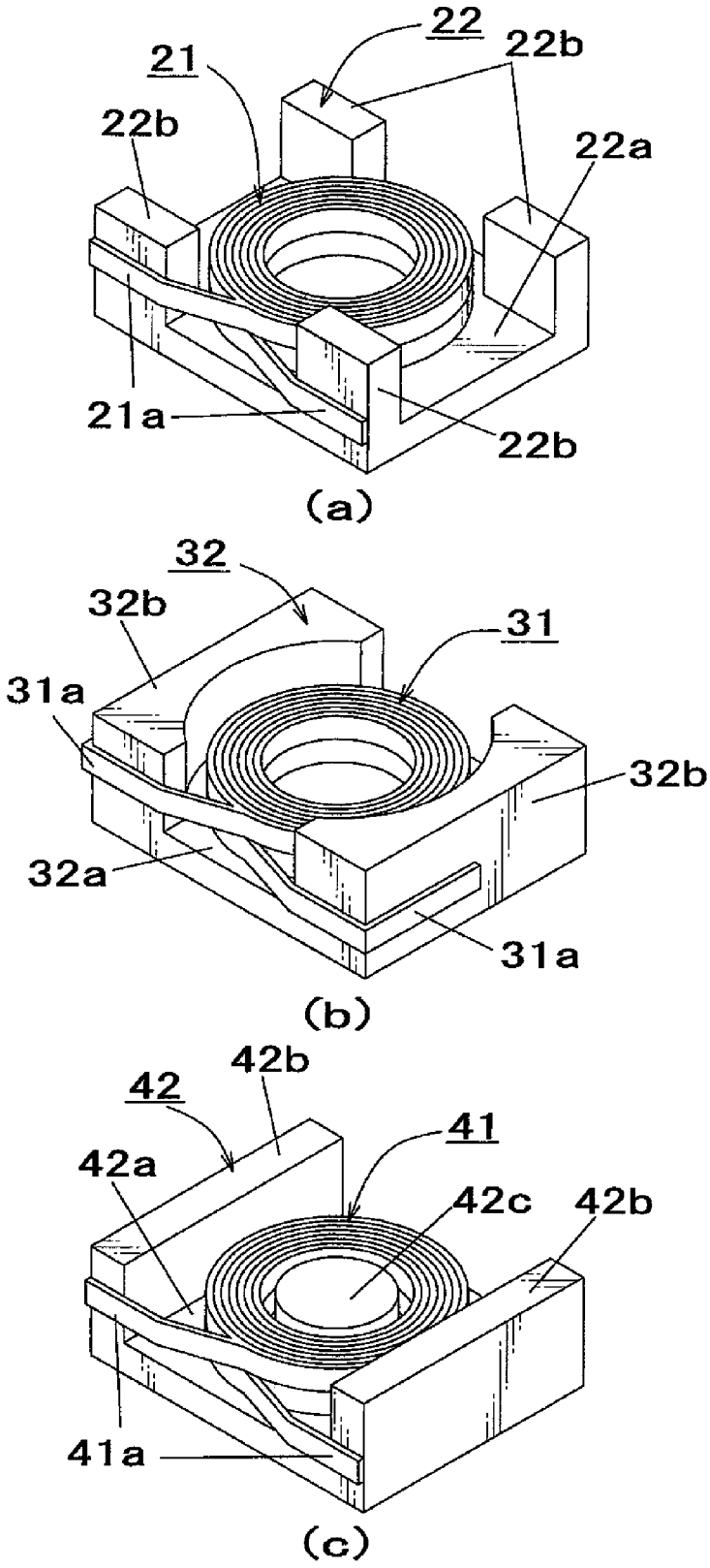
FIGS. 13(*a*) to 13(*c*) are perspective views showing a positional relationship between an air-core coil and a base tablet, in various examples of modification of the production method according to the present invention.

With reference to FIGS. 13(*a*) to 13(*c*), various examples of modification of the production method according to the present invention will be described. FIGS. 13(*a*) to 13(*c*) are perspective views showing a positional relationship between an air-core coil and a tablet, in each of the modifications.

As shown in FIG. 13(*a*), four pillar-shaped convex portions 22*b* may be provided on four corners of a flat plate-shaped portion 22*a* of a base tablet 22. In this case, during a process of encapsulating an air-core coil 21, a distribution in a charging pressure of an encapsulation material tends to become more evened out, which makes it possible to more reliably prevent displacement of the air-core coil 21 so as to obtain a surface-mount inductor at a high degree of molding accuracy.

As shown in FIG. 13(*b*), a pair of pillar-shaped convex portions 32*b* of a base tablet 32 may be formed to surround an air-core coil 31. In this case, a positioning of the air-core coil 31 can be facilitated. In addition, this makes it possible to more reliably prevent displacement of the air-core coil 31 during a process of encapsulating the air-core coil 31 so as to obtain a surface-mount inductor at a high degree of molding accuracy.

Alternatively, the pillar-shaped convex portions 32*b* may also be formed such that any side surfaces of the base tablet 32*a* are extended, in addition to on the corners as in the above-described example. This makes it possible to increase the strength of the base tablet so as to reduce damage of the base tablet during the production process. Further, shown in FIG. 13(*b*), each of opposite ends 31*a* of the air-core coil 31 may be arranged to extend across a lateral surface of the pillar-shaped convex portion 32*b* forming a corner portion of the base tablet. In this case, an area of a portion of the end 31*a* to be exposed to a surface of a molded body to be obtained can be increased. This makes it possible to sufficiently obtain a contact area between the air-core coil and an external electrode so as to obtain a surface-mount inductor having a smaller contact resistance.

As shown in FIG. 13(*c*), a pillar-shaped convex portion 42*c* for positioning an air-core coil 41 may be provided on a base tablet 42. In this case, a positioning of the air-core coil 41 can be facilitated. In addition, this makes it possible to more reliably prevent displacement of the air-core coil 41 during a process of encapsulating the air-core coil 41 so as to obtain a surface-mount inductor at a high degree of molding accuracy.

In the above embodiments, an iron-based metal magnetic powder and an epoxy resin are used as the filler and the resin of the encapsulation material, respectively. The use of the iron-based metal magnetic powder makes it possible to produce a surface-mount inductor excellent in DC superposition characteristic. Alternatively, the filler for used in the encapsulation material may be a ferritic magnetic powder or a glass powder. Further, the resin for used in the encapsulation material may be other thermosetting resin, such as a polyimide resin or a phenol resin, or may be a thermoplastic resin, such as a polyethylene resin or a polyamide resin.

In the above embodiments, the base tablet is preformed in a half-set state. Alternatively, the base tablet is preformed in an unset state. In the above embodiments, the pillar-shaped convex portion of the base tablet is preformed in a rectangular columnar shape. Alternatively, the pillar-shaped convex portion may be appropriately formed in a different shape, such as a shape having a curved lateral surface, depending on an intended purpose.

In the above embodiments, the air-core coil obtained by winding a rectangular wire in a two-tiered spiral pattern is used as a coil. Alternatively, the coil may be an edgewise wound coil, or an oval or rectangular-shaped coil.

In the first embodiment, the unset platy tablet is used as the preformed material. However, a shape of the preformed material is not limited to a plate-like shape, but the preformed material may be preformed in any other suitable shape, such as a T shape or an E shape. Further, the preformed material may be preformed in a half-set state, instead of an unset state. Furthermore, a method for forming the preformed material may be appropriately selected depending on an intended purpose. For example, it may be preformed by a pressure forming process or may be cut out from a sheet-shaped material.

What is claimed is:

1. A method of producing a surface-mount inductor by encapsulating a coil with an encapsulation material containing a resin and a filler using a mold die assembly, said method comprises the steps of:

preparing a first tablet by preforming a part of the encapsulation material, the first tablet is prepared such that it has a flat portion formed such that it has a plate shape and a convex portion formed such that it has a pillar shape on a peripheral of the flat portion;

preparing the coil by winding conductive wire having a rectangular cross-section to form an air-core coil;

placing the air-core coil on the flat portion of the first tablet to allow both ends of the air-core coil to extend along an outer side surface of the convex portion of the first tablet, and disposing the air-core coil and the first tablet in the mold die assembly such that the both ends of the air-core coil are clamped between an inner wall surface of the mold die assembly and the outer side surface of the convex portion of the first tablet;

loading a second tablet prepared with the rest of the encapsulation material into the mold die assembly;

integrating the first tablet, the air-core coil and the second tablet together by using a resin molding process or a powder molding process while clamping the both ends of the air-core coil between the inner wall surface of the mold die assembly and the outer side surface of the convex portion of the first tablet, to form a molded body such that at least portions of the ends of the air-core coil are exposed to the surface of the molded body; and forming external electrodes on a surface of or around an outer periphery of the molded body in such a manner that the external electrodes are electrically connected to the both ends of the coil at least a portion of which is exposed to the surface of the molded body.

2. The method as defined in claim 1, wherein the resin of the encapsulation material includes a thermosetting resin, and wherein the first tablet is preformed in an unset or half-set state.

3. The method as defined in claim 1, wherein the first tablet is formed such that the tablet has a plurality of the pillar-shaped convex portions.

4. The method as defined in claim 1, wherein the filler comprises a magnetic material.

* * * * *